US009725227B2

(12) United States Patent
Chow

(10) Patent No.: US 9,725,227 B2
(45) Date of Patent: Aug. 8, 2017

(54) LAUNDRY HAMPER SYSTEM CONFIGURED TO MAINTAIN A LEVEL OF CONTAINED ITEMS AT OR NEAR AN OPENING

(71) Applicant: Doris King Chow, Upper Marlboro, MD (US)

(72) Inventor: Doris King Chow, Upper Marlboro, MD (US)

( * ) Notice: Subject to any disclaimer, the term of this patent is extended or adjusted under 35 U.S.C. 154(b) by 0 days.

(21) Appl. No.: 14/955,019

(22) Filed: Nov. 30, 2015

(65) Prior Publication Data

US 2017/0152098 A1 Jun. 1, 2017

(51) Int. Cl.

| | |
|---|---|
| ***B65D 25/04*** | (2006.01) |
| ***B65D 83/00*** | (2006.01) |
| ***D06F 95/00*** | (2006.01) |
| ***B65D 25/28*** | (2006.01) |
| ***B65D 25/10*** | (2006.01) |
| ***B65D 43/14*** | (2006.01) |
| ***B65D 21/02*** | (2006.01) |

(52) U.S. Cl.

CPC ..... *B65D 83/0005* (2013.01); *B65D 21/02* (2013.01); *B65D 25/04* (2013.01); *B65D 25/10* (2013.01); *B65D 25/28* (2013.01); *B65D 43/14* (2013.01); *D06F 95/002* (2013.01); *B65D 83/005* (2013.01); *B65D 83/0011* (2013.01)

(58) Field of Classification Search

CPC ..... B62M 6/60; B60B 7/0007; B60B 27/0015
See application file for complete search history.

(56) References Cited

U.S. PATENT DOCUMENTS

| | | | | |
|---|---|---|---|---|
| 3,168,271 | A | 2/1965 | Deschenes | |
| 3,583,748 | A | 6/1971 | Arndt | |
| 4,300,611 | A | 11/1981 | Silverman | |
| 5,405,043 | A * | 4/1995 | Meloney | D06F 95/002 211/119.004 |
| 7,090,092 | B1 * | 8/2006 | Roebuck, Jr. | D06F 95/002 220/629 |
| 2003/0230924 | A1 | 12/2003 | Davidovic | |
| 2014/0008360 | A1 | 1/2014 | Philip | |

* cited by examiner

*Primary Examiner* — John Walters
*Assistant Examiner* — James Triggs
(74) *Attorney, Agent, or Firm* — Pillsbury Winthrop Shaw Pittman LLP

(57) ABSTRACT

The present disclosure relates to a laundry hamper system configured to maintain a level of contained items at or near an opening of the container. The laundry hamper system comprise one or more of a receptacle, a receptacle lid, a coupling mechanism, one or more sensors, a controller, a user interface, a platform, a lift mechanism, one or more wheels, a power source, and/or other components. One or more sensors may be configured to facilitate the lift mechanism to maintain the level of the one or more items contained by the receptacle at or near the opening by moving the platform away from the opening responsive to the one or more items contained by the receptacle breaching the threshold level, moving the platform toward the opening responsive to the one or more items contained by the receptacle failing to breach the threshold level, and/or other operations, in accordance with some implementations.

20 Claims, 3 Drawing Sheets

LAUNDRY HAMPER SYSTEM CONFIGURED TO MAINTAIN A LEVEL OF CONTAINED ITEMS AT OR NEAR AN OPENING

FIELD OF THE DISCLOSURE

The present disclosure relates to a laundry hamper system configured to maintain a level of contained items at or near an opening.

BACKGROUND

Conventional laundry containers having a movable structure within for maintaining contained items at or near the container opening typically require manual operation or include spring systems that do not provide consistent lifting for clothing with similar volumes but different weights (e.g., sweatpants versus denim jeans).

SUMMARY

One or more aspects of the disclosure relate to a laundry hamper system configured to maintain a level of contained items at or near an opening. Exemplary implementations may facilitate maintaining a level of contained items at or near an opening of the container by using one or more sensors to detect whether contained items breach a threshold level and by using a lift mechanism to automatically adjust the level toward or away from the opening. In some implementations, the laundry hamper system may be configured to facilitate easier access to items held within a container. In some implementations, in addition to the one or more sensors and lift mechanism, the laundry hamper system may include one or more of a receptacle, a receptacle lid, a coupling mechanism, a controller, a user interface, a platform, one or more wheels, a power source, a handle, ventilation apertures, partition, and/or other components.

The receptacle may be configured to contain a plurality of items.

The receptacle lid may be configured to facilitate exposing and/or covering the opening. The receptacle lid may be mechanically coupled with the receptacle by way of a coupling mechanism. The coupling mechanism may be configured to facilitate movement of the receptacle lid in both covering and/or exposing the opening.

The one or more sensors may be configured to provide a signal conveying an indication of whether one or more items contained by the receptacle breach a threshold level proximate to the opening, in accordance with some implementations. Such information may include or be used to determine that the threshold level is breached responsive to the receptacle lid exposing the opening and/or that the threshold level is not breached responsive to the receptacle lid covering the opening.

The platform may be disposed within the receptacle. The platform may be configured to support physical items contained by the receptacle.

The lift mechanism may be configured to facilitate movement of the platform toward or away from the receptacle opening.

The controller may be configured to cause the lift mechanism to maintain the level of the one or more items contained by the receptacle at or near the opening. The controller may be configured to cause the lift mechanism to maintain the level of the one or more items contained by the receptacle at or near the opening by (1) moving the platform away from the opening responsive to the one or more items contained by the receptacle breaching the threshold level, or (2) moving the platform toward the opening responsive to the one or more items contained by the receptacle failing to breach the threshold level, and/or other operations, in accordance with some implementations.

The user interface may be configured to receive information from a user and/or provide information to the user. As such, the user interface may include hardware and/or software to facilitate receiving information from the user and/or providing information to the user. In some implementations, the user interface may be configured to present user configurable settings to the user. The user interface may be configured to receive selections from the user of values for the user configurable settings. One or more user configurable settings may impact the current activity of one or more components of the laundry hamper system. The user configurable settings may be related to manual control of operations by the lift mechanism and/or other operations, in accordance with some implementations.

In some implementations, the receptacle may be configured to facilitate physically coupling with one or more other receptacles that may be the same as and/or similar to the receptacle.

The power source may be configured to supply electrical power to one or more components of the laundry hamper system. In some implementations, the power source may be rechargeable. In some implementations, the receptacle may be further configured to facilitate electrically coupling with the one or more other receptacles such that electrical power may be transmitted between the receptacle and individual ones of the one or more other receptacles. In some implementations, the receptacle and/or additional coupled receptacles may receive electrical power from a component of the laundry hamper system and/or another source to recharge the power source.

The one or more wheels disposed on the receptacle at an external surface opposite the opening may be configured to facilitate manually moving the laundry hamper system from one location to another location.

The handle disposed on the receptacle at an external surface may be configured to provide a hand grip point to facilitate manually holding and/or controlling the movement of the laundry hamper system.

In some implementations, the receptacle may include a heating system and/or a cooling system configured to facilitate regulation of internal temperature and/or air flow in the laundry hamper system.

In some implementations, the receptacle may be configured to receive an insertable and removable partition between the platform and the opening. The partition may be configured to compartmentalize sets of items held within the receptacle.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the present disclosure. As used in the specification and in the claims, the singular form of "a", "an", and "the" include plural referents unless the context clearly dictates otherwise.

DETAILED DESCRIPTION

Figure 1:
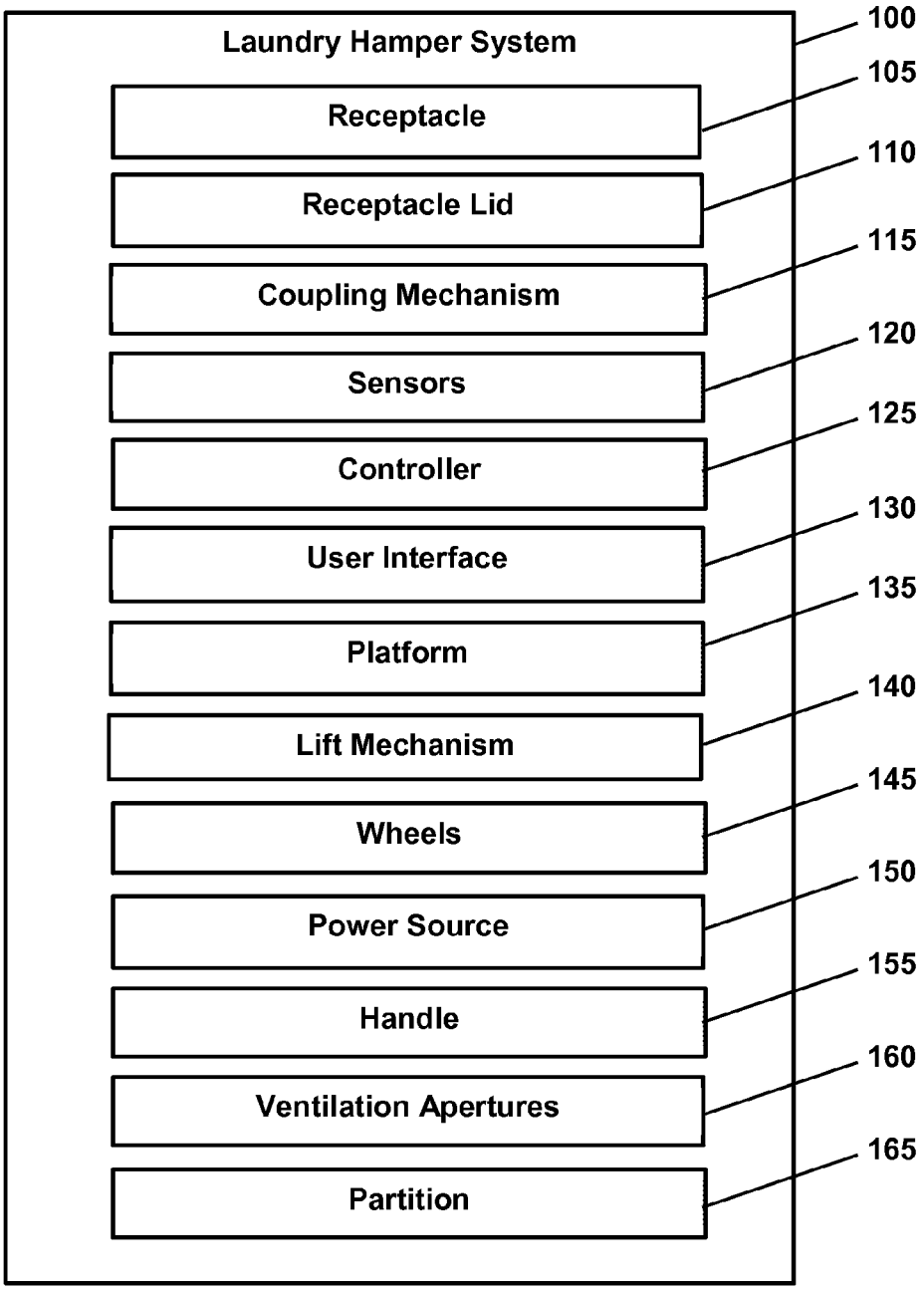
FIG. 1 illustrates a laundry hamper system configured to facilitate maintaining a level of contained items at or near an opening of the laundry hamper system, in accordance with one or more implementations.

FIG. 1 illustrates a laundry hamper system 100 configured to facilitate maintaining a level of contained items at or near an opening of the laundry hamper system 100, in accordance with one or more implementations. In some implementations, laundry hamper system 100 may include one or more of a receptacle 105, a receptacle lid 110, a coupling mechanism 115, one or more sensors 120, a controller 125, a user interface 130, a platform 135, a lift mechanism 140, one or more wheels 145, a power source 150, a handle 155, ventilation apertures 160, a partition 165, and/or other components.

The receptacle 105 may be configured to contain a plurality of items such as various laundry items. Examples of laundry items may include one or more of shirts, pants, socks, undergarments, and/or other laundry items. The receptacle 105 may include one or more openings configured to receive laundry items and to provide access to items contained by receptacle 105. In some implementations, receptacle 105 may have a containment volume in a range between about two cubic feet and about ten cubic feet, inclusive (e.g., 2 $ft^3$, 2.5 $ft^3$, 3 $ft^3$, 3.5 $ft^3$, 4 $ft^3$, 4.5 $ft^3$, 5 $ft^3$, 5.5 $ft^3$, 6 $ft^3$, 6.5 $ft^3$, 7 $ft^3$, 7.5 $ft^3$, 8 $ft^3$, 8.5 $ft^3$, 9 $ft^3$, 9.5 $ft^3$, 10 $ft^3$, and/or other volumes). These volumetric values should not be interpreted as limiting as other values are contemplated and are within the scope of the disclosure. In some implementations, receptacle 105 may be formed in whole or in part of one or more materials which may include one or more of plastic, polymer, metal, textile, wood, ceramics, plywood, aluminum, fiberglass, carbon fiber, laminate, and/or other materials. In some implementations, a footprint of receptacle 105 may be shaped as one or more of a square, a rectangle, a circle, a polygon, an ellipse, a crescent, and/or other shapes.

In some implementations, receptacle 105 may be configured to couple with one or more other receptacles that may be the same as and/or similar to receptacle 105. By way of non-limiting example, receptacle 105 may couple with one or more other receptacles by way of a coupling mechanism. Examples of such a coupling mechanism may include one or more of magnetic attachment, interlocking connection, link-and-pin coupling, knuckle coupler, flange, male/female connectors, and/or other coupling mechanism.

The receptacle lid 110 may be configured to expose and/or cover the opening. By way of non-limiting example, receptacle lid 110 may expose the opening for adding items into the receptacle or removing items held within the receptacle. By way of non-limiting example, receptacle lid 110 may cover the opening for concealing items held within the receptacle. The receptacle lid 110 may be mechanically coupled with receptacle 105 by way of a coupling mechanism 115. The coupling mechanism 115 may be configured to facilitate movement of receptacle lid 110 in both covering and/or exposing the opening. By way of non-limiting example, coupling mechanism 115 may include one or more of a hinge, a joint, a pivot, a swivel, a hinging mechanism, and/or other mechanism configured to movably couple receptacle 105 and receptacle lid 110. In some implementations, receptacle lid 110 may be formed in whole or in part of one or more materials which may include one or more of plastic, polymer, metal, textile, wood, ceramics, plywood, aluminum, fiberglass, carbon fiber, laminate, and/or other materials. In some implementations, a footprint of receptacle lid 110 may be shaped as one or more of a square, a rectangle, a circle, a polygon, an ellipse, a crescent, and/or other shapes.

The platform 135 may be disposed within receptacle 105. The platform 135 may support physical items contained by receptacle 105. For example, platform 135 may include a rigid, planar structure on which physical items rest within receptacle 105. In some implementations, platform 135 may be formed in whole or in part of one or more materials which may include one or more of plastic, polymer, metal, textile, wood, ceramics, plywood, aluminum, fiberglass, carbon fiber, laminate, and/or other materials. The platform 135 may have a footprint matching that of receptacle 105. In some implementations, a footprint of platform 135 may be shaped as one or more of a square, a rectangle, a circle, a polygon, an ellipse, a crescent, and/or other shapes.

The lift mechanism 140 may be configured to facilitate movement of platform 135 toward or away from the opening of receptacle 105. By way of non-limiting example, lift mechanism 140 may include one or more of a mechanical lift, a hydraulic lift, a pneumatic lift, a worm drive, a screw mechanism, a pulley system, a belt, an actuator, a motor, and/or other technologies suitable for facilitating movement of platform 135, in accordance with some implementations. In some implementations, the lift mechanism 140 may have a maximum lifting capacity of up to about 200 lbs. In some implementations, the lift mechanism 140 may have a maximum lifting capacity in a range between about 10 lbs. and about 200 lbs. These weight values should not be interpreted as limiting as other values are contemplated and are within the scope of the disclosure.

The one or more sensors 120 may be configured to provide a signal conveying an indication of whether one or more items contained by the receptacle breach a threshold level proximate to the opening. In some implementations, the threshold level may be a plane or line that crosses a lateral dimension of receptacle 105 at or near the opening. The sensors 120 may include one or more of a photoelectric sensor, an "electric eye" transmitter/receiver pair, a photodetector, a light transmitter, a receiver, a proximity sensor, a position sensor, a laser sensor, an infrared sensor, a photocell, and/or other technologies for determining the presence of physical items, in accordance with some implementations. By way of non-limiting example, sensors 120 may be disposed on one or more opposing sides of receptacle 105 (see, e.g., FIG. 2) such that one sensor 120 transmit light and an opposing sensor 120 receives the transmitted light. An interruption in the transmitted light being received by the opposing sensor 120 may be caused by physical items contained by receptacle 105 blocking the transmitted light, and thereby breaching a threshold level established by the positions of the sensors 120. Movement by the lift mechanism may be responsive to the one or more sensors 120 indicating a threshold level breach, as described further in connection with controller 125.

The one or more sensors 120 may include an angle sensor associated with coupling mechanism 115. The angle sensor may be configured to provide a signal conveying lid angle information related to an angle at which receptacle lid 110 is opened. The sensors 120 may include one or more of a rotary position sensor, a roller switch, and/or other technologies for determining an angle. The receptacle lid angle information may be used to determine the direction of movement of the lift mechanism. The direction of the lift mechanism movement may be responsive to the angle of the lid breaching a threshold value, in accordance with some implementations.

The controller 125 may be configured to control one or more components of laundry hamper system 100. The controller 125 may be configured to receive information from the one or more sensors 120. The controller 125 may be configured to cause movement of lift mechanism 140 responsive to information from sensors 120. By way of non-limiting example, controller 125 may be configured to control lift mechanism 140. For example, controller 125 may be configured to cause movement of lift mechanism 140 toward the receptacle opening, cause movement of lift mechanism 140 away from the receptacle opening, cause lift mechanism 140 to remain stationary, and/or other movement operations.

Controller 125 may be configured to provide information processing capability in the individual components of laundry hamper system 100 in which they are included, and/or in laundry hamper system 100 as a whole. As such, controller 125 may include one or more of a digital processor, an analog processor, a digital circuit designed to process information, an analog circuit designed to process information, a state machine, and/or other mechanisms for electronically processing information. Although controller 125 is shown in FIG. 1 as a single entity, this is for illustrative purposes only. In some implementations, controller 125 may include a plurality of processing units. These processing units may be physically located within the same device (e.g., within laundry hamper system 100) or controller 125 may represent processing functionality of a plurality of devices operating in coordination. Controller 125 may be configured to enable an expert and/or user to interface with sensors 120, user interface 130, and/or other devices, and/or provide other functionality attributed herein to laundry hamper system 100.

In some implementations, controller 125, together with sensors 120, lift mechanism 140, and/or other devices, may control the position of platform 135 responsive to a breach of a threshold level, an angular threshold value, and/or other thresholds. The threshold level may indicate and/or include a section within the receptacle whereby breach of this section (e.g., by items received by the receptacle) may cause movement of platform 135. This section may be disposed between the opening of the receptacle and a level proximate to the opening of the receptacle. One or more of the sensors 120 may be disposed at and/or near the threshold level. The one or more sensors 120 may be configured to provide a signal conveying an indication of whether one or more items contained by receptacle 105 breach the threshold level, in accordance with some implementations. By way of non-limiting example, controller 125 may be configured to maintain the level of the one or more items contained by receptacle 105 at or near the opening by (1) moving platform 135 away from the opening responsive to the one or more items contained by receptacle 105 breaching the threshold level, or (2) moving platform 135 toward the opening responsive to the one or more items contained by receptacle 105 failing to breach the threshold level, and/or other operations, in accordance with some implementations. By way of non-limiting example, as laundry items are removed from the receptacle (i.e., to be washed), sensors 120 may detect an absence of items proximate to the receptacle opening, thereby prompting movement of the remaining laundry items supported by platform 135 toward the receptacle opening.

The angle of receptacle lid 110 may be used to determine the direction of movement of lift mechanism 140. The direction of the lift mechanism movement may be responsive to the angle of the lid breaching the angular threshold value. By way of non-limiting example, lift mechanism 140 may be configured to maintain the level of the one or more items contained by receptacle 105 at or near the opening by (1) moving platform 135 away from the opening responsive to receptacle lid 110 failing to breach the angular threshold value and one or more items contained by receptacle 105 breaching the interior threshold level, or (2) moving platform 135 toward the opening responsive to receptacle lid 110 breaching the angular threshold value and the one or more items contained by receptacle 105 failing to breach the threshold level, and/or other operations, in accordance with some implementations. By way of non-limiting example, as receptacle lid 110 is moved pivotably such that the receptacle opening is exposed and/or the angular threshold value may be breached, as laundry items are removed from the receptacle (i.e., to be washed), sensors 120 may detect an absence of items proximate to the receptacle opening, thereby prompting movement of the remaining laundry items supported by platform 135 toward the receptacle opening.

The user interface 130 may be configured to receive information from a user and/or provide information to the user. As such, user interface 130 may include hardware and/or software to facilitate receiving information from the user and/or providing information to the user. Examples of input devices may include one or more of a touch screen, a touch pad, a keypad, a switch, an analog stick, a button, a dial, a knob, and/or other hardware configured to receive information from a user. Examples of output devices may include one or more of a display, a touch screen, an LED, and/or other hardware configured to provide information to a user. In some implementations, user interface 130 may be configured to present user configurable settings to the user. The user interface 130 may be configured to receive selections from the user of values for the user configurable settings. One or more user configurable settings may impact the current activity of one or more components of laundry hamper system 100. By way of non-limiting example, the user configurable settings may activate and/or deactivate one or more components of laundry hamper system 100, and/or may configure one or more aspects of operation of laundry hamper system 100. The user configurable settings may be related to manual control of operations by lift mechanism 140 and/or other operations, in accordance with some implementations.

By way of non-limiting example, user interface 130 may be configured to manually control one or more of the direction of movement of platform 135, the range of movement of platform 135, the stationary location of platform 135, and/or other operations. By way of non-limiting example, user interface 130 may be configured to disengage automatic movement of platform 135. By way of non-limiting example, as laundry items are removed from the receptacle (i.e., to be washed), a user may manually control the position of the remaining laundry items supported by platform 135.

By way of non-limiting example, user interface 130 may be configured to provide the user one or more indications of laundry hamper system 100 functions including one or more of whether receptacle 105 is full, whether receptacle 105 encounters an operational error, battery charge levels, a malfunction notification, and/or other operational indicators, in accordance with some implementations. By way of non-limiting example, an indication that receptacle 105 is full may be responsive to receptacle 105 reaching maximum capacity of received items. Such an indication may include one or more of an audible indicator, a visual indicator, and/or other indicators. By way of non-limiting example, an indication that receptacle 105 encounters an operational error may be responsive to one or more of receptacle 105 exceeding maximum weight capacity, items causing a blockage, mechanical failure, and/or other operational errors.

The power source 150 may be configured to supply electrical power to one or more components of laundry hamper system 100. By way of non-limiting example, power source 150 may include one or more of a battery, a capacitor, apparatus for receiving electrical power from an external source (e.g., a wall socket), and/or other power supplies. In some implementations, power source 150 may be rechargeable. In some implementations, receptacle 105 may be configured to electrically couple with one or more other receptacles such that electrical power may be transmitted between receptacle 105 and individual ones of the one or more other receptacles. By way of non-limiting example, receptacle 105 may electrically couple with one or more other receptacles by way of electrical conduction, conductive coupling, electromagnetic induction, inductive coupling, impedance matching, capacitive coupling, wire, common terminal, and/or other electrical coupling methods. In some implementations, receptacle 105 and/or additional coupled receptacles may receive electrical power from a component of laundry hamper system 100 and/or another source to recharge power source 150.

The one or more wheels 145 may be disposed on receptacle 105 at an external surface opposite the opening. The one or more wheels 145 may be configured to facilitate manually moving laundry hamper system 100 from one location to another location. By way of non-limiting example, one or more wheels 145 may include one or more swivel caster wheels, ball bearings, slide tracks, belt track, pedrail wheel, and/or other mechanism configured to facilitate manually moving laundry hamper system 100 from one location to another location.

The handle 155 may be disposed on receptacle 105 at an external surface. The handle 155 may be configured to provide a hand grip point to facilitate manually holding and/or controlling the movement of laundry hamper system 100. By way of non-limiting example, handle 155 may include one or more of a handle, a grip, a knob, and/or other part configured to facilitate manually holding and/or controlling the movement of laundry hamper system 100.

In some implementations, receptacle 105 may include a heating system and/or cooling system configured to facilitate regulation of internal temperature and/or air flow in laundry hamper system 100. By way of non-limiting example, internal temperature and/or air flow regulators may include a cooling apparatus, a heating apparatus, insulation, ventilation, and/or other temperature regulation apparatus. The ventilation apertures 160 may include one or more of a plurality of apertures within the outer body of receptacle 105 configured to facilitate the ventilation of air throughout the receptacle and items contained therein.

In some implementations, receptacle 105 may be configured to receive an insertable and removable partition 165 between platform 135 and the opening. The partition 165 may be configured to compartmentalize sets of items held within the receptacle. By way of non-limiting example, the partition 165 may be comprised of multisectional parallel members that telescope into and out of itself such that the partition 165 elongates and/or shortens responsive to movement by platform 135. By way of non-limiting example, the partition 165 may be attached at one of its ends to the rim of the receptacle opening and attached at its other end to platform 135.

Figure 2:
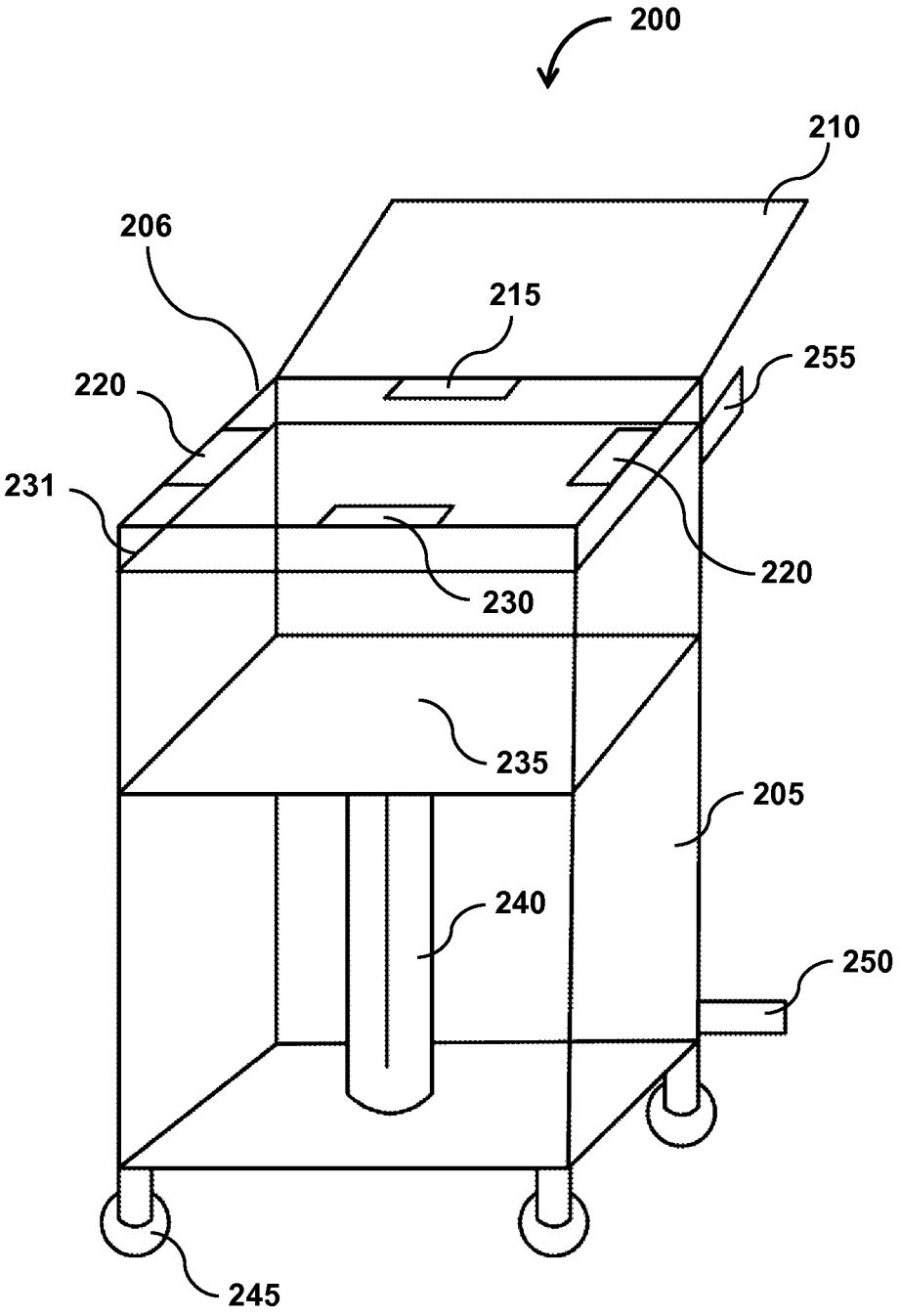
FIG. 2 illustrates an exemplary implementation of a laundry hamper system.

FIG. 2 illustrates an exemplary implementation of a laundry hamper system, in accordance with one or more implementations. In some implementations, laundry hamper system 100 may operate automatically without user input. In some implementations, laundry hamper system 100 comprises a movable structure, such as a height adjustable interior platform (e.g., platform 135). Laundry hamper system 100 facilitates access to contained items at or near the container opening, in accordance with one or more implementations.

FIG. 2 illustrates an exemplary implementation of a laundry hamper system 200. The laundry hamper system 200 may include one or more components that are the same as or similar to laundry hamper system 100 described in connection with FIG. 1. For example, laundry hamper system 200 may include one or more of a receptacle 205, a receptacle lid 210, a coupling mechanism 215, one or more sensors 220, a controller 225, a user interface 230, a platform 235, a lift mechanism 240, one or more wheels 245, a power source 250, a handle 255, ventilation apertures 260, partition 265, and/or other components. The receptacle 205 may be the same as or similar to receptacle 105 (see FIG. 1), in accordance with one or more implementations. The receptacle 205 may include opening 206. The receptacle 205 may include a threshold level 231 at or near which a level of contained items is maintained. The receptacle lid 210 may be the same as or similar to receptacle lid 110 (see FIG. 1), in accordance with one or more implementations. The coupling mechanism 215 may be the same as or similar to coupling mechanism 115 (see FIG. 1), in accordance with one or more implementations. The one or more sensors 220 may be the same as or similar to the one or more sensors 120 (see FIG. 1), in accordance with one or more implementations. The controller 225 may be the same as or similar to controller 125 (see FIG. 1), in accordance with one or more implementations. The user interface 230 may be the same as or similar to user interface 130 (see FIG. 1), in accordance with one or more implementations. The platform 235 may be the same as or similar to platform 135 (see FIG. 1), in accordance with one or more implementations. The lift mechanism 240 may be the same as or similar to lift mechanism 140 (see FIG. 1), in accordance with one or more implementations. The one or more wheels 245 may be the same as or similar to the one or more wheels 145 (see FIG. 1), in accordance with one or more implementations. The power source 250 may be the same as or similar to power source 150 (see FIG. 1), in accordance with one or more implementations. The handle 255 may be the same as or similar to handle 155 (see FIG. 1), in accordance with one or more implementations. The ventilation apertures 260 may be the same as or similar to ventilation apertures 160 (see FIG. 1), in accordance with one or more implementations. The partition 265 may be the same as or similar to partition 165 (see FIG. 1), in accordance with one or more implementations.

Figure 3:
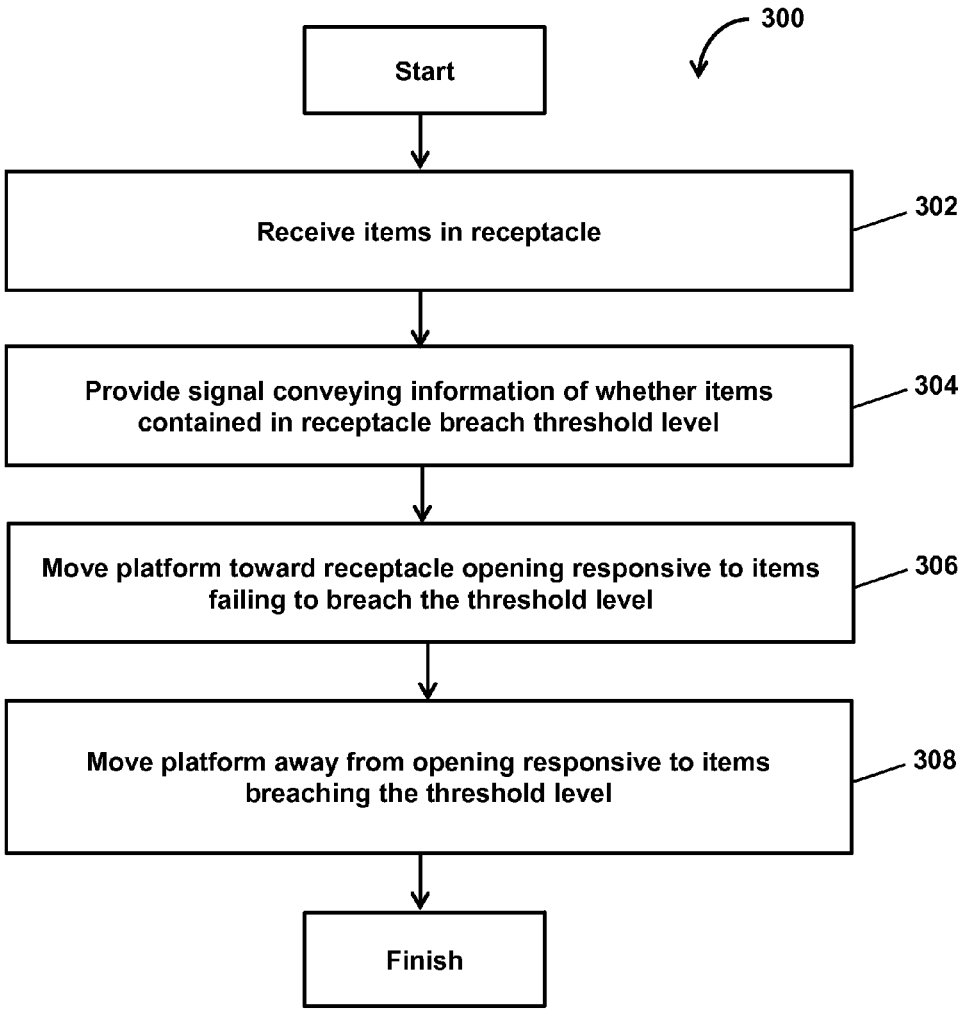
FIG. 3 illustrates a method for facilitating maintaining a level of contained items at or near an opening of a laundry hamper system, in accordance with one or more implementations.

FIG. 3 illustrates a method 300 for facilitating maintaining a level of contained items at or near an opening of a laundry hamper system, in accordance with one or more implementations. The operations of method 300 presented below are intended to be illustrative. In some implementations, method 300 may be accomplished with one or more additional operations not described, and/or without one or more of the operations discussed. Additionally, the order in which the operations of method 300 are illustrated in FIG. 3 and described below is not intended to be limiting.

In some implementations, one or more operations of method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on an electronic storage medium. The one or more processing devices may include one or more devices configured through hardware, firmware, and/or software to be specifically designed for execution of one or more of the operations of method 300.

At an operation 302, a plurality of items may be received by the receptacle. The receptacle comprises the opening of the laundry hamper system, the opening being configured to receive items to be contained by the receptacle. Operation 302 may be performed by a receptacle that is similar to and/or the same as receptacle 105 (see FIG. 1), in accordance with one or more implementations.

At an operation 304, a signal may be provided conveying an indication of whether one or more items contained by the receptacle breach a threshold level proximate to the opening. The signal may be provided by one or more sensors. The signal may be provided to a controller. Operation 304 may be performed by one or more sensors that is similar to and/or the same as sensors 120 (see FIG. 1), in accordance with one or more implementations.

At an operation 306, a platform may be moved toward the opening responsive to the one or more items contained by the receptacle breaching the threshold level. A lift mechanism may be configured to facilitate movement of the platform. The lift mechanism may be caused to move by the controller. Operation 306 may be performed by a platform, lift mechanism, and/or controller that are similar to and/or the same as platform 135, lift mechanism 140, and/or controller 125, respectively, (see FIG. 1), in accordance with one or more implementations.

At an operation 308, a platform may be moved away from the opening responsive to the one or more items contained by the receptacle failing to breach the threshold level. A lift mechanism may be configured to facilitate movement of the platform. The lift mechanism may be caused to move by the controller. Operation 306 may be performed by a platform, lift mechanism, and/or controller that are similar to and/or the same as platform 135, lift mechanism 140, and/or controller 125, respectively, (see FIG. 1), in accordance with one or more implementations.

While implementations of this disclosure are described in the context of laundry, this should not be interpreted as limiting as other contexts are contemplated. For example, in one or more implementations, the laundry hamper system 100 may be a container system configured to contain recyclable items, grocery items, food items, toy items, mail items, and/or other physical items.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A laundry hamper system configured to maintain a level of contained items at or near an opening of the laundry hamper system, the system comprising:

a receptacle configured to contain a plurality of items, the receptacle comprising the opening of the laundry hamper system, the opening being configured to receive items to be contained by the receptacle;

a platform disposed within the receptacle, the platform being configured to support items contained by the receptacle;

a lift mechanism configured to move the platform toward or away from the opening;

one or more sensors configured to provide a signal conveying an indication of whether one or more items contained by the receptacle breach a threshold level proximate to the opening; and a controller configured to cause the lift mechanism to maintain the level of the one or more items contained by the receptacle at or near the opening by (1) moving the platform away from the opening responsive to the one or more items contained by the receptacle breaching the threshold level, and (2) moving the platform toward the opening responsive to the one or more items contained by the receptacle failing to breach the threshold level.

2. The laundry hamper system of claim 1, further comprising a power source, the power source being configured to provide power to one or both of the lift mechanism or the controller.

3. The laundry hamper system of claim 1, wherein individual ones of the one or more sensors include one or more of a photoelectric sensor, a photodetector, a light transmitter, a receiver, a proximity sensor, a position sensor, a laser sensor, an infrared sensor, or a photocell.

4. The laundry hamper system of claim 1, further comprising a receptacle lid mechanically coupled with the receptacle by way of a coupling mechanism, the coupling mechanism being configured to facilitate movement of the receptacle lid in both covering and exposing the opening.

5. The laundry hamper system of claim 4, wherein the one or more sensors are further configured such that the indication conveyed by the signal is that (1) the threshold level is breached responsive to the receptacle lid exposing the opening and (2) the threshold level is not breached responsive to the receptacle lid covering the opening.

6. The laundry hamper system of claim 1, further comprising a user interface configured to provide manual control of whether the lift mechanism (1) moves the platform toward the opening, (2) moves away from the opening, or (3) remains stationary.

7. The laundry hamper system of claim 1, further comprising a user interface configured to provide an indication of whether the receptacle is full.

8. The laundry hamper system of claim 1, further comprising two or more wheels disposed on the receptacle at an external surface opposite the opening, the one or more wheels being configured to facilitate manually moving the laundry hamper system from one location to another location.

9. The laundry hamper system of claim 1, wherein the receptacle is further configured to removably couple with one or more other receptacles that are the same as or similar to the receptacle.

10. The laundry hamper system of claim 8, wherein the receptacle is further configured to electrically couple with the one or more other receptacles such that electrical power is transmitted between the receptacle in individual ones of the one or more other receptacles.

11. The laundry hamper system of claim 1, wherein the lift mechanism includes one or more of a mechanical lift, a hydraulic lift, a pneumatic lift, a worm drive, a screw mechanism, a pulley system, a belt, an actuator, or a motor.

12. The laundry hamper system of claim 1, wherein the receptacle has a containment volume in a range between about two cubic feet and about eight cubic feet.

13. The laundry hamper system of claim 1, wherein the plurality of items the receptacle is configured to contain includes one or more of laundry items, recyclable items, grocery items, or toy items.

14. The laundry hamper system of claim 1, wherein the receptacle is formed of one or more materials including one or more of plastic, polymer, metal, textile, wood, ceramics, plywood, aluminum, fiberglass, carbon fiber, or laminate.

15. The laundry hamper system of claim 1, wherein the receptacle is further comprised of a plurality of apertures within the outer body of the receptacle configured to facilitate the ventilation of air throughout the receptacle and items contained therein.

16. The laundry hamper system of claim 1, wherein a footprint of the receptacle is shaped as one or more of a square, a rectangle, a circle, a polygon, an ellipse, or a crescent.

17. The laundry hamper system of claim 1, further comprising a handle disposed near the receptacle opening configured to provide a grip point to facilitate manually moving the receptacle.

18. The laundry hamper system of claim 1, wherein the lift mechanism has a maximum lifting capacity in a range between about 10 lbs. and about 200 lbs.

19. The laundry hamper system of claim 1, further comprising an insertable and removable partition disposed between the platform and the opening configured to compartmentalize sets of items held within the receptacle.

20. The laundry hamper system of claim 1, further comprising a user interface configured to provide an indication of whether the receptacle encounters an operational error including one or more of exceeding maximum weight capacity, battery charge levels, or a malfunction notification.

* * * * *